US009380399B2

(12) United States Patent
Noah

(10) Patent No.: US 9,380,399 B2
(45) Date of Patent: Jun. 28, 2016

(54) HANDHELD INTERFACE FOR SPEAKER LOCATION

(71) Applicant: Summit Semiconductor LLC, Hillsboro, OR (US)

(72) Inventor: Jeffery Owen Noah, Beaverton, OR (US)

(73) Assignee: Summit Semiconductor LLC, Hillsboro, OR (US)

( * ) Notice: Subject to any disclaimer, the term of this patent is extended or adjusted under 35 U.S.C. 154(b) by 76 days.

(21) Appl. No.: 14/267,514

(22) Filed: May 1, 2014

(65) Prior Publication Data

US 2015/0098596 A1 Apr. 9, 2015

Related U.S. Application Data

(63) Continuation-in-part of application No. 14/050,082, filed on Oct. 9, 2013.

(51) Int. Cl.
*H04R 5/02* (2006.01)
*H04S 7/00* (2006.01)

(52) U.S. Cl.
CPC . *H04S 7/301* (2013.01); *H04R 5/02* (2013.01); *H04R 2205/024* (2013.01); *H04R 2420/07* (2013.01)

(58) Field of Classification Search
CPC ..... H04R 5/02; H04S 7/301
USPC ..... 381/303
See application file for complete search history.

(56) References Cited

U.S. PATENT DOCUMENTS

| | | | | |
|---|---|---|---|---|
| 5,386,478 | A | 1/1995 | Plunkett | |
| 5,666,424 | A | 9/1997 | Fosgate et al. | |
| 7,123,731 | B2 | 10/2006 | Cohen et al. | |
| 7,155,017 | B2 | 12/2006 | Kim et al. | |
| 7,158,643 | B2 | 1/2007 | Lavoie et al. | |
| 7,272,073 | B2 | 9/2007 | Pellegrini et al. | |
| 7,319,641 | B2 | 1/2008 | Goudie et al. | |
| 7,676,044 | B2 | 3/2010 | Sasaki et al. | |
| 8,199,941 | B2 | 6/2012 | Hudson et al. | |
| 2007/0133813 | A1 | 6/2007 | Morishima | |
| 2012/0113224 | A1 * | 5/2012 | Nguyen | G06T 7/0065 348/46 |

FOREIGN PATENT DOCUMENTS

WO 2006131893 A1 12/2006

* cited by examiner

*Primary Examiner* — Simon King
(74) *Attorney, Agent, or Firm* — Chernoff, Vilhauer, McClung & Stenzel, LLP

(57) ABSTRACT

An interface for balancing speaker sound for use in consumer electronics and professional sound reinforcement field features a wireless speaker array. Optimization is accomplished by assigning the correct audio channel to each wireless speaker by a "chime" sound with multiple frequency components, and optimizing the sound of the speaker array by providing a wireless transmitter device with precise positions of each item for subsequent optimization of relative gain and delay for each speaker relative to the sweet spot.

10 Claims, 8 Drawing Sheets

HANDHELD INTERFACE FOR SPEAKER LOCATION

CROSS-REFERENCE TO RELATED APPLICATION

This application is a continuation in part of U.S. application Ser. No. 14/050,082 filed Oct. 9, 2013, the entire disclosure of which is hereby incorporated herein by reference for all purposes.

SUMMARY OF THE INVENTION

The subject matter of this application relates to a user interface for balancing speaker sound in the markets ranging from consumer electronics to professional sound reinforcement field.

Wireless speaker array installation and optimization is accomplished by assigning the correct audio channel to each wireless speaker by a "chime" sound with multiple frequency components, and optimizing the sound of the speaker array by providing a wireless transmitter device with precise positions of each item for subsequent optimization of relative gain and delay for each speaker relative to the sweet spot.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE DRAWINGS

Figure 1:
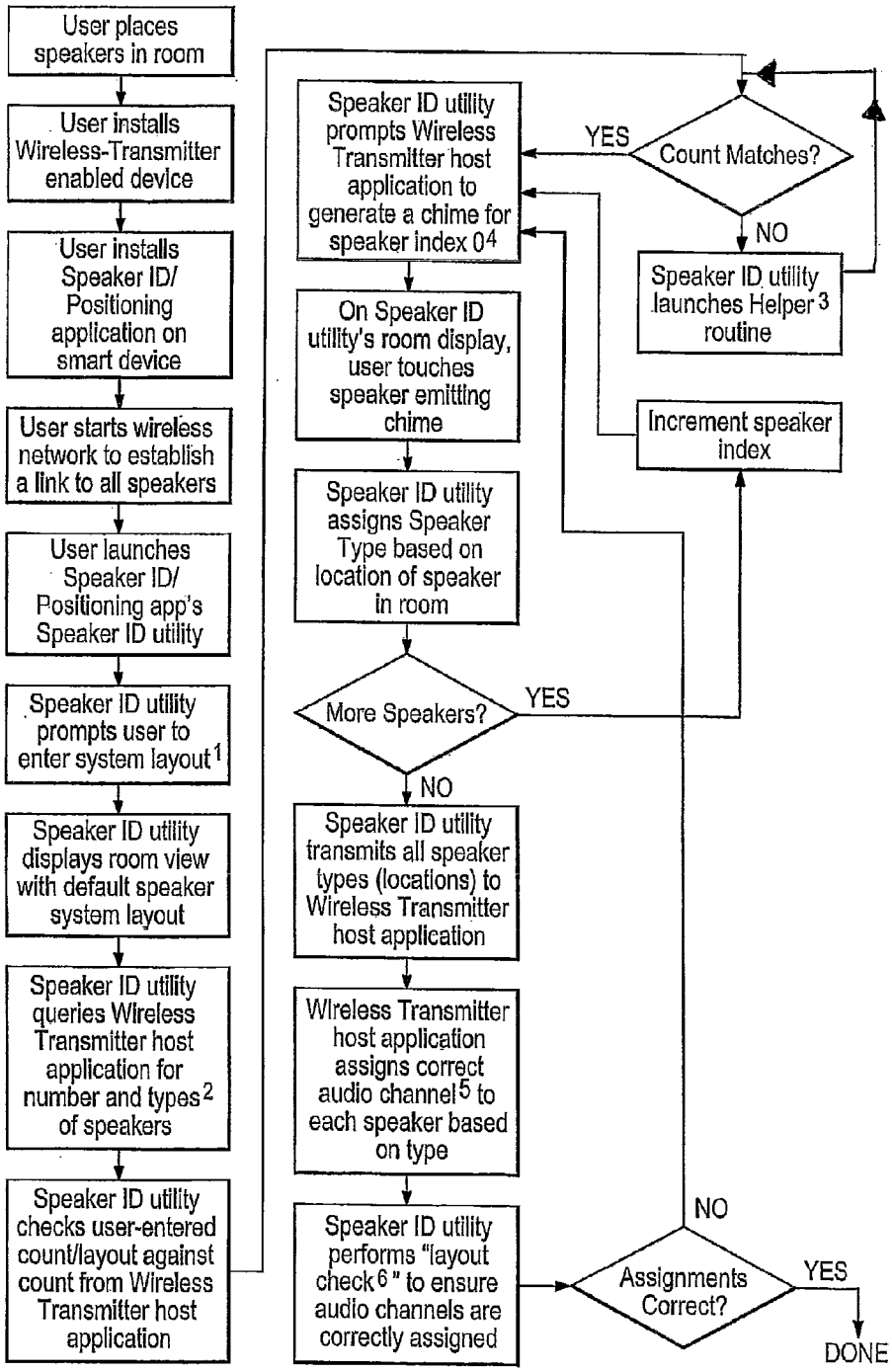
FIG. 1 is a process flow chart for Speaker Identification Utility steps.

Creating a coherent sound field at a specific point or area, known as the "sweet spot," in a room greatly improves the listening experience when a system of two or more speakers are employed to deliver the sound. Creating and enjoying this coherent sound field applies equally to wired and wireless speaker technology.

Existing (and previously proposed) solutions to accomplish this task, each with its own shortcomings, incorporate a variety of technologies, from cumbersome manual entry of distances through an Audio/Video Receiver (AVR) interface, to ultrasonic "pinger" arrays that automatically calculate the necessary distances—but require clear line of sight to all speakers and careful placement of a reference speaker to optical beam transmitters built into speakers (mentioned in US 2012/0148075 A1), to calibrated microphone measurements of specific tone levels generated by an AVR or other device measured one speaker at a time (such as those offered by Audyssey™).

Consumers typically do not have the skill or patience to make reasonably accurate measurements of speaker locations relative to the center of the sweet spot only to have to use the typical interface of an AVR, which are generally considered to be user-unfriendly. The use of a calibrated microphone to measure tones from each speaker is another task typical consumers are not comfortable with, and possibly not sufficiently skilled to perform.

The key component involved in the calculation of a coherent sound field is distance, assuming all speakers generate the same sound pressure level from the same input signal level, within a relatively small tolerance of less than ±1.5 dBSPL. From distance, the relative volume of two speakers located at different distances from the sweet spot can be calculated as well as the relative delay required for sound from the closer speaker(s) arrive at the listening position at the same time as does sound from the most distant speaker in the system. Typically, the distance parameters (relative to listening position) would be delivered or input to an AVR for wired systems, or to a wireless audio transmitter device for wireless speaker systems. In these cases, the AVR or Wireless transmitter would then calculate the relative volume and delay required to establish the coherent sound field at the desired sweet spot.

Wireless speaker array installation and optimization is improved by the use of the disclosure herein; that is by assigning the correct audio channel to each wireless speaker by a "chime" sound with multiple frequency components, and optimizing the sound of the speaker array by providing the wireless transmitter device with precise positions of each item, for subsequent optimization of relative gain and delay for each speaker relative to the sweet spot.

In wired speaker arrays there is a physical link via speaker wire between the audio output device and each speaker, which accomplishes the task of identifying or assigning which channel of a multi-channel audio program is to be sent to each speaker. Wireless speaker arrays can be assembled with wireless speakers that fall into two major categories, those having pre-assigned speaker types and those with a generic type (no pre-assigned speaker type). Given the potential for incorrect placement within the room of pre-assigned speaker types, the need for conclusive speaker identification is at least beneficial if not required for correct sound system function with either category of wireless speakers.

Given the simplicity of measuring a distance from the front of a speaker cabinet to a listening position is well within the capabilities of the average consumer, a simple and easily changeable method of inputting fairly precise speaker position information to the system is the most expedient approach. The preferred embodiment of this invention is realized by providing a simple interface on a smart device, be it a smart phone or modern tablet computer or similar device, that provides the consumer with a graphical representation of the physical layout of the room containing the speaker system, and a simple method a) to identify each speaker by type (e.g., left front, right surround, etc.), and b) to optimize the sound field by setting precise x-y speaker and sweet spot positions within that room. However, a less graphically rich interface where consumers can enter the correct speaker type and input a distance value relative to the sweet spot, or precise x-y coordinates of each speaker and the sweet spot relative to the same origin point within the room, with the smart device calculating the speaker-to-sweet spot distances, could be equally effective in accomplishing the task.

On the smart device, the a Speaker Identification and Positioning application could provide speaker positioning with either a completely graphical input method or strictly via text input or a combination of both.

The wireless speaker array in a single room, with the center speaker (if the system has more than two front speakers) located in front of a display device, and other wireless speakers are positioned around the room in one of the industry recognized surround sound configurations. A Speaker Identification and Positioning application is installed on a smart device with wireless capabilities to communicate with the Wireless Transmitter enabled device.

The first desired, but not required, information the Speaker Identification and Positioning application prompt the user to provide is the general dimensions of the room, to prevent the user from entering speaker location information that is outside the physical bounds of the room and cannot achieve the desired sound field coherency.

Once room dimensions are entered, the Speaker Identification and Positioning application must know the configuration of the wireless speaker array (e.g., 2.0, 3.1, 5.1, and 7.4). If room dimensions are not entered, a default room size is used. With room size and speaker array configuration entered, the Speaker Identification and Positioning application draws a representation of the physical room with default speaker placements as suggested by the speaker array configuration.

If not already powered on, the wireless speakers and Wireless Transmitter enabled device (Tx Device) should be powered on, and the smart device running the Speaker Identification and Positioning application should connect to the Tx Device's host application using a common wireless technology enabled on both devices.

Once connected, the Speaker Identification and Positioning application detects if the Tx Device has a saved setup. In the "No saved setup" case as is expected with an initial system installation, the Speaker Identification and Positioning application queries the Tx Device for a list of speakers and speaker types currently in the wireless network.

The Speaker Identification and Positioning application compares the speaker array configuration entered by the user with the system information provided by the Tx Device based on the current wireless speaker network state. If the two quantities of speakers do not match a Helper routine assists the user in correcting the issue. If more speakers were found than expected, the Speaker Identification and Positioning application's Helper utility provides a list of all "found" speakers in a table that includes the MAC address or other uniquely identifiable marking found on each speaker. The user can compare the Helper's MAC/other marking list with each speaker in the room to determine any the extra speaker, and guide the user through removing extra or unwanted speakers from the wireless speaker network.

If too few speakers are found, the Helper utility guide the user through the process of adding missing speakers.

When the speaker count is correct, the Speaker Identification and Positioning application displays the room layout view and instructs the user to touch the speaker icon in the room display that corresponds to the physical speaker emitting the chime, which locks that speaker to the correct audio channel. This is possible since the Speaker Identification and Positioning application designates that the speaker in the front left corner of the room display on the smart device should be tied to the front left audio channel, and therefore assigns the front left audio channel to that speaker. The process repeats for each speaker in the array until all speakers have been assigned an audio channel.

To allow the user to double check the assignments, the Speaker Identification and Positioning application then chimes each speaker a few times while highlighting the speaker icon in the location that should be tied to the audio channel currently chiming. Once all speakers have been chimed during this check process and are found to be correctly assigned, this process is complete. If any incorrect assignments are noted, the process repeats until correct.

Speaker Positioning

The wireless transmitter device is then given the precise positions of each item (speakers and listening position or "sweet spot"), for subsequent optimization of relative gain and delay for each speaker relative to the sweet spot.

Figure 5:
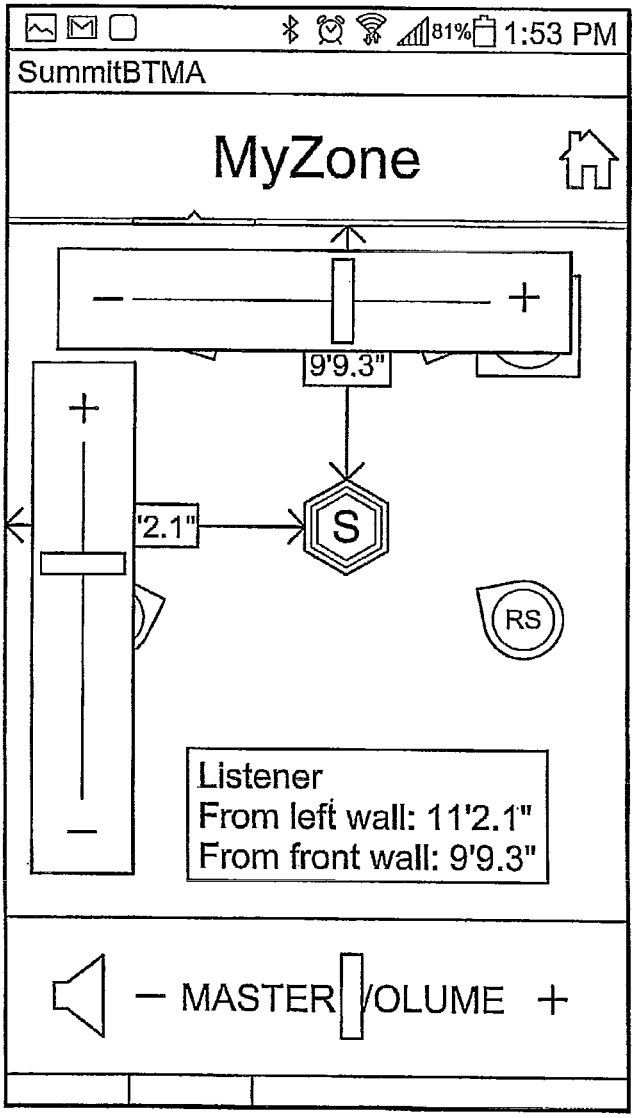
FIG. 5 is an illustration of speaker position adjustment graphics.
Figure 6:
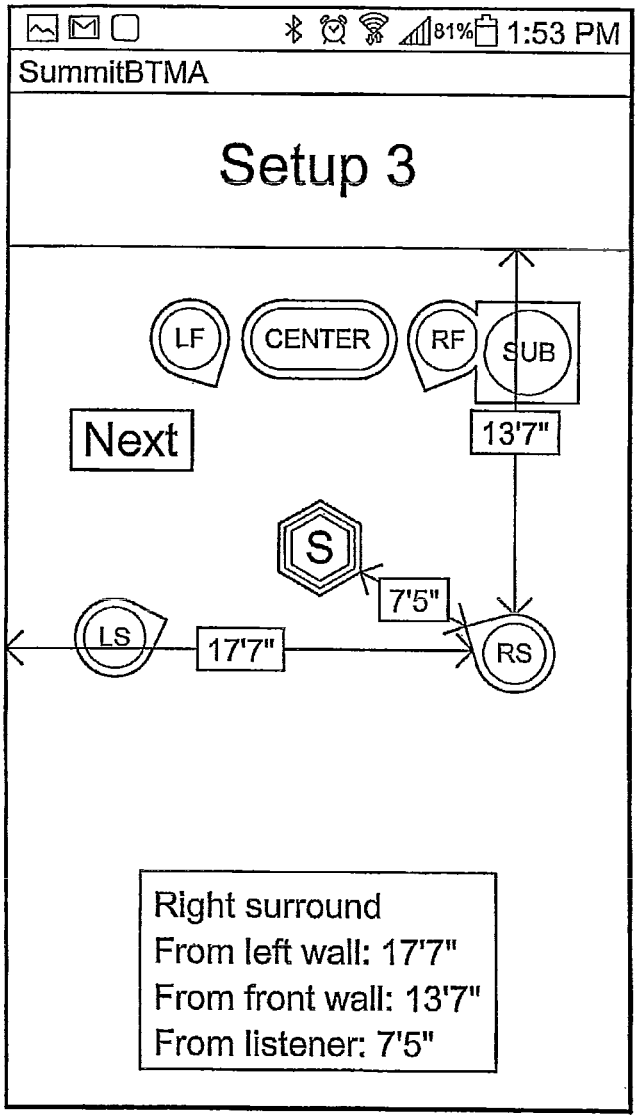
FIG. 6 is an illustration of sweet spot adjustment fine graphics.
Figure 7:
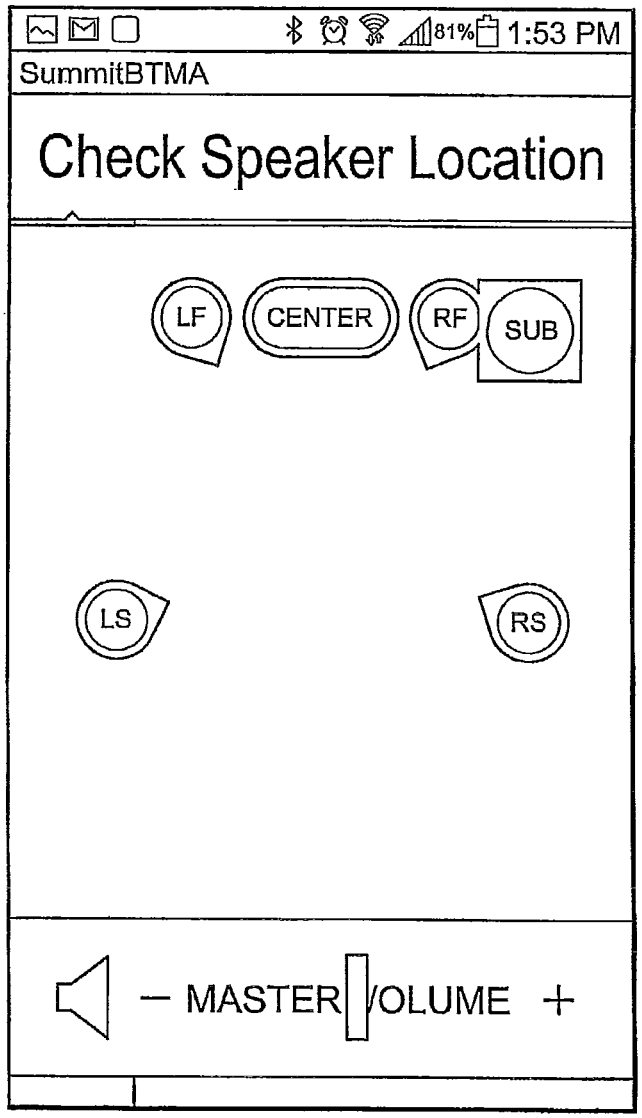
FIG. 7 is an illustration of a speaker positioning map.
Figure 8:
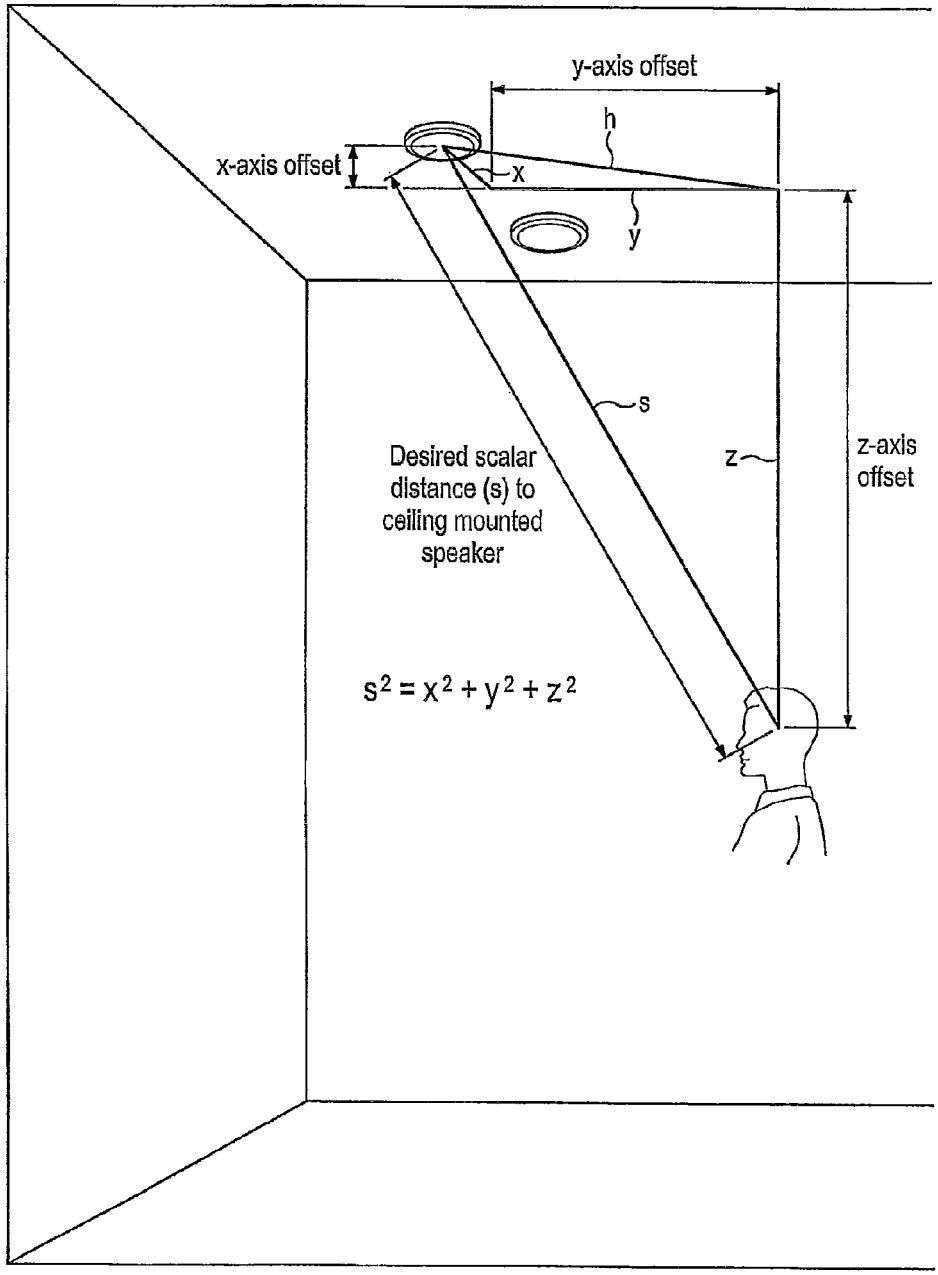
FIG. 8 is an illustration of a vertical offset dimensional example.

Graphical positioning within the application's room-boundary is performed using a drag-to-position mode for coarse positioning. An example of this coarse adjustment is shown at FIG. 5. Higher resolution special positioning can then be accomplished by invoking a set of x-y slider bars that employ a scale such that large movements of the bar result in fine movements of the item. This is illustrated by way of example in FIG. 6. The use of a double-tap or long press or menu item could be used to open the fine-tune slider bars for any item (speaker or sweet spot) in the system. Alternately, double-tapping the item could bring up a text entry field along with a digits-only keypad to enter any item's x-y position, or alternately, enter a scalar distance from the sweet spot for speakers. This calculation is shown in FIG. 8. Once text entry is complete for an item using the latter method, the item would jump to that location within the room. The textual input could handle both coarse and/or fine adjustments for items.

In a non-graphical implementation, items could be presented in a list that includes their default x-y or scalar distance to sweet spot locations, and touching to select (or other method of selection) would again enable a text entry field along with a digits-only keypad to enter the desired positional information.

Further, the use of an On Screen Display (OSD) on a television, with speaker positions either graphically placed in a room with a remote control using up-down-left-right arrows, or with distances/x-y locations entered from the keypad or other method using the TV remote control, can be envisioned as a related form of implementation of this invention that is particularly relevant to implementations where the wireless transmitter is located within the TV itself.

The current implementation of this invention transmits both relative distance between each speaker and the sweet spot and the x-y room coordinates of each speaker and the sweet spot directly from the handheld device to the Tx Device host application, which forwards the data to the wireless transmitter firmware. The firmware within the wireless transmitter (not Tx Device's host application) calculates the average distance for all speakers to the sweet spot, and generates a delay value for each speaker, with the speaker most distant from the sweet spot receiving 0 milliseconds delay.

The individual delay and distance values are subsequently transmitted to each speaker, as is the average distance for all speakers from the sweet spot. Each speaker then applies the delay factor it received, and calculates its own difference in distance to the sweet spot from the average distance of all speakers, and uses that value to adjust its volume up or down from the system volume sent to all speakers to ensure each speaker has the correct relative volume at the sweet spot regardless of placement.

Alternately, in wireless speaker networks where a more generic wireless audio networking technology is supported, the handheld device could calculate the average speaker distance from the sweet spot and make the delay calculations locally, and then transmit the information directly to the speaker, and the speaker would add the gain correction factor and delay value to the audio signal it receives from the Tx Device.

The preceding description handles nearly all cases for existing technologies in deployed in home theater and professional sound reinforcement implementations today. With the advent of "3D" sound, where emerging technologies have the capability to create a more realistic sound field either by deploying up-firing speakers or by placing speakers in the ceiling to enhance the spatial dimensions of the listening experience, another axis of speaker placement becomes a necessity.

The room dimension entry would need to include a ceiling height (z-axis) dimension for proper spatial optimization of ceiling mounted or up-firing speakers. Floor- or wall-mounted speakers in the system could also benefit from a z-axis placement parameter for cases where the speaker is vertically offset from the sweet spot by more than one foot/30 centimeters.

FIG. 1 is a flow chart for the process of speaker identification. As illustrated, a user places speakers where desired, for example in a home theater room. A user installs a wireless-transmitter enabled device for transmitting audio signals. Additionally, a user installs a Speaker Identification and Positioning application on a smart device such as a smart phone. It will be appreciated that these users may be identical or different individuals. The wireless-transmitter enabled device may be any of a variety of audio source device types, such as a television, AVR, or wireless audio hub.

The user initiates the wireless network and establishes a link to the speakers. Speakers are automatically assigned a zero-based index number corresponding to the order in which they are discovered and added to the network. Then the user launches the speaker ID utility associated with the Speaker Identification and Positioning application. This utility prompts the user to input a user-entered system layout which may be one of several common home theater loudspeaker arrays recognizable to the utility and which identifies the number and types of speakers. Such arrays include stereo (2.0; left and right) or surround (5.1; center, left front, right front, left surround, right surround, and subwoofer). The utility causes the display to show a room view with a default speaker system layout for the selected speaker array.

The speaker ID utility then queries the wireless transmitter host application for the number and types of speakers. The speakers may have pre-assigned types recognizable to the host application, such as "left front" or "right surround"; however a speaker may alternatively have no such pre-assigned type.

The speaker ID utility compares the user-entered system layout with the host-identified system layout. If the user-entered system layout does not match the number of speakers in the host-identified system layout, the speaker ID utility launches a helper routine. The helper routine guides the user though the process of editing the user-entered system layout by adding or removing speakers to or from the user-entered system layout. The speaker ID utility compares the user-entered system layout with the host-identified system layout again and repeats the helper routine if there is still not a match.

Once there is a match between number of speakers in the user-entered system layout and the host-identified system layout, the speaker ID utility prompts the wireless transmitter host to generate a chime signal for a single speaker, in an order based upon the speaker index value (0 to n). The speaker with index 0 will continue to chime until assigned a location by a user.

A user assigns the desired speaker location by tapping on the speaker icon shown on the speaker ID utility's room display that corresponds to the speaker emitting the sound. The speaker ID utility then generates a chime signal for the next speaker, in index number order, until the positions of all speakers are assigned.

The speaker ID utility initiates a routine to confirm that the audio channel assignments to each speaker are correct by instructing the wireless transmitter host application to chime each speaker, one at a time, while the speaker ID utility indicates which speaker should preferentially output the indicated audio channel.

The user confirms the audio channel assignment is satisfactory. If the assignment is not satisfactory, the speaker ID utility reinitiates the sequence of steps to identify speakers and revises assignments.

Figure 2:
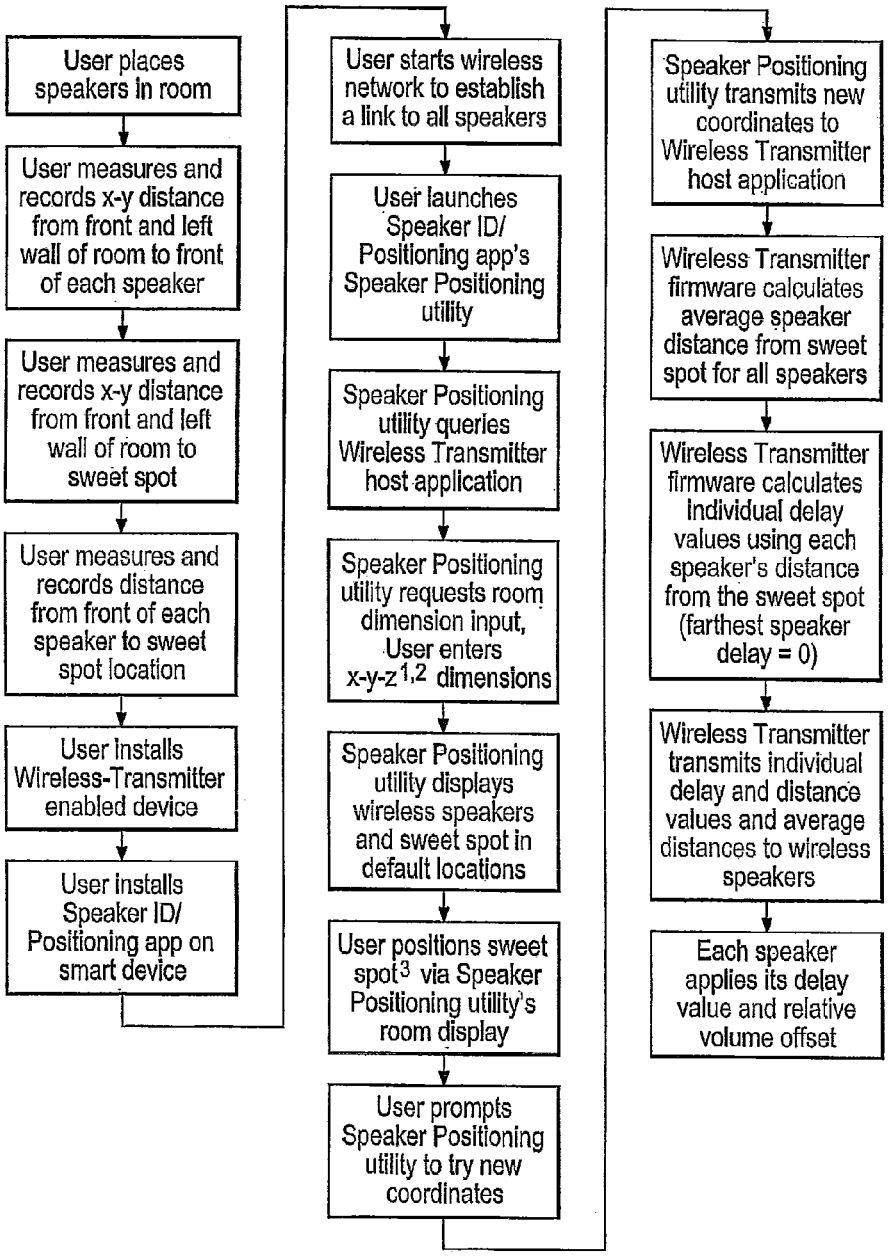
FIG. 2 is a flow chart for Speaker Positioning Utility steps.

FIG. 2 is a flow chart outlining the speaker positioning process. As illustrated therein, the user places wireless speakers in the desired locations in a space. The user measures the distances between a speaker, a sweet spot, and the front and left wall of the space. This is repeated for each speaker.

A user initiates a wireless network and establishes a link thereto from each wireless speaker and to a wireless-transmitter enabled device.

A user installs on a smart device a speaker positioning application which includes a speaker positioning utility. The speaker positioning utility queries the wireless transmitter host application for speaker identification and audio channel assignments, if available, and default speaker locations.

Figure 3:
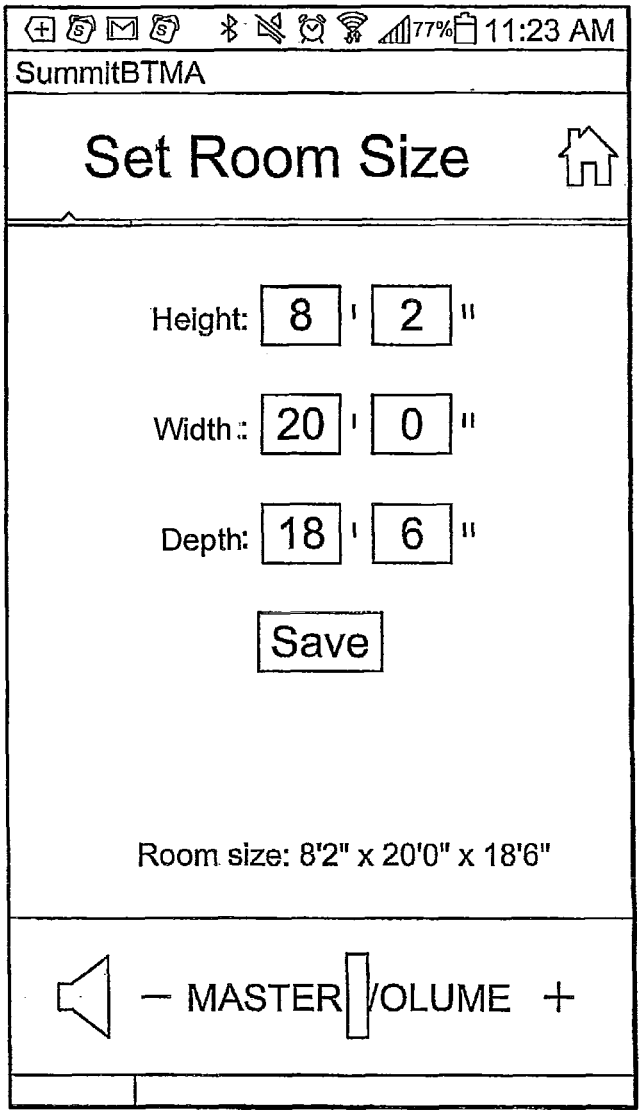
FIG. 3 is an illustration of a display used to adjust room dimensions.
Figure 4:
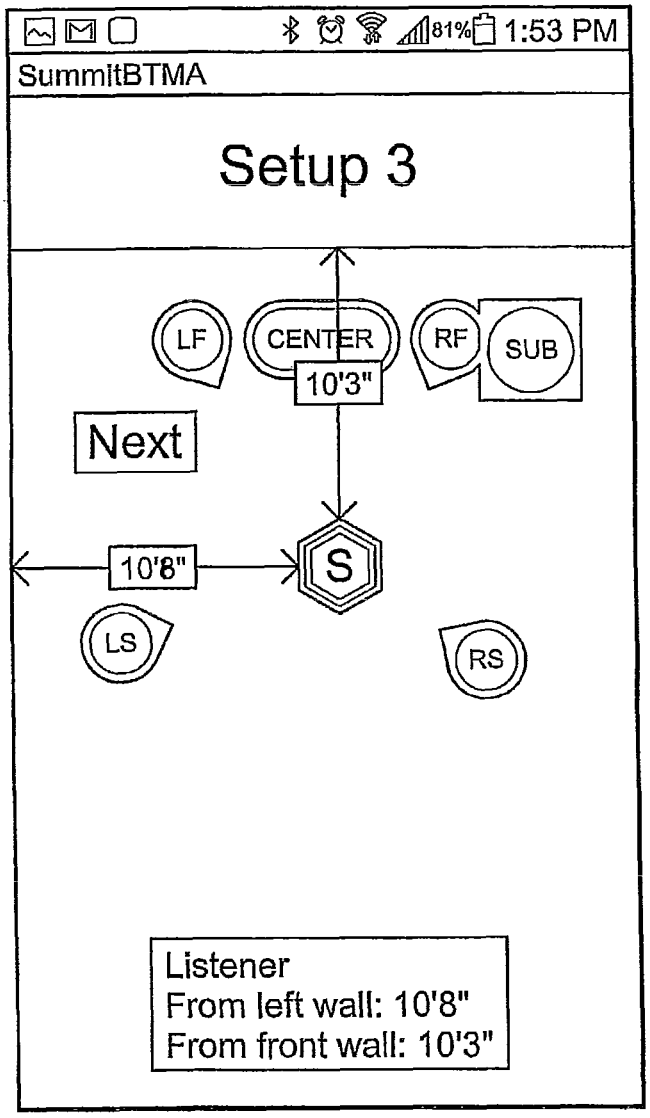
FIG. 4 is an illustration of sweet spot adjustment coarse graphics.

The speaker positioning utility requests room dimensions of at least a width and length, and optionally a height. This is illustrated at FIG. 3. From these dimensions and the speaker locations, the speaker positioning utility generates a room map and displays thereon the linked wireless speakers in their default locations. The speaker positioning utility additionally generates a sweet spot default location.

The user enters into the speaker positioning utility the distances between each speaker, a sweet spot, and the front and left wall of the space. The speaker positioning utility modifies the room map to display the entered locations or coordinates. The speaker positioning utility, using the x-y coordinates of the sweet spot and all speaker positions, calculates the average and individual speaker distance from the sweet spot, and subsequently transmits to the wireless transmitter host application the new entered x-y room coordinates for the sweet spot and for each speaker, the individual scalar distances from each speaker to the sweet spot, the average scalar distance of all speakers to the sweet spot, along with the speaker size (large or small).

The wireless transmitter host application transfers to the wireless transmitter module both the average scalar distance of all speakers from the sweet spot as well as the individual scalar distance of each speaker. The wireless transmitter module firmware calculates the individual delay values and relative volumes for each speaker, with the most distant speaker, relative to the sweet spot, receiving no delay.

The wireless transmitter transmits individual delay, distance values, and average distance to each wireless speaker. Each wireless speaker applies its delay value and relative volume offset.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. A method for management of speaker sound with a wireless transmitter device and a handheld speaker management unit having a speaker identification utility, a speaker positioning utility, and a processor coupled to a memory and display screen, the method comprising:

a) collecting data representative of a plurality of speaker location values into the handheld speaker management unit;

b) displaying a map of collection data;

c) comparing the collected data whether user entered location data;

d) prompting the wireless transmitter device to generate a chime at each speaker;

e) permitting adjustment of speaker location values;

f) generating a speaker index;

g) evaluating whether a channel assignment is appropriate for each speaker; and h) permitting a user to override the channel assignment.

2. The method of claim 1, in which location data includes a distance from at least two wall points and from a sweet-spot.

3. The method of claim 2, further comprising the step of calculating a delay value for each speaker and transmitting at least one delay value to at least one speaker.

4. The method of claim 3, further comprising the step of determining an average distance value for each speaker, transmitting at least one speaker location value and the average distance value to at least one speaker, and determining a relative volume offset for each speaker.

5. A system comprising: a processor configured to analyze speaker location data, the speaker location data comprising data describing speaker location relative to walls, audio source, and a sweet-spot; a processor configured to rank each speaker position in a audio channel index according the each respective speaker position; a processor configured to select for display all speaker positions having a audio channel and the sweet-spot; a processor configured to draw a schematic map comprising speaker position, a sweet-spot indicator, and audio qualities selected for display; a display configured to display the schematic map; and a user interface to configured to accept user inputs instructing one or more of the processors to generate or modify the schematic map.

6. The system of claim 5, wherein the processors are distributed among one or more devices in the system.

7. The system of claim 6, wherein the processors exist in one or more servers and a handheld device.

8. The system of claim 5, wherein the processors are all embodied in a single processor in a handheld device.

9. The system of claim 5, wherein the audio qualities include at least one of a group consisting of volume, delay, gain, and channel assignment.

10. The system of claim 5, wherein the speaker positions can be re-ranked.

* * * * *